US005411834A

United States Patent [19]

Fuller et al.

[11] Patent Number: 5,411,834

[45] Date of Patent: May 2, 1995

[54] LIQUID DEVELOPER COMPOSITIONS WITH FLUOROALKYL GROUPS

[75] Inventors: Timothy J. Fuller, Pittsford; James R. Larson, Fairport; John W. Spiewak, Webster; David H. Pan, Rochester; Ralph A. Mosher, Rochester; Frank J. Bonsignore, Rochester, all of N.Y.

[73] Assignee: Xerox Corporation, Stamford, Conn.

[21] Appl. No.: 204,012

[22] Filed: Feb. 24, 1994

[51] Int. Cl.[6] ..... G03G 9/135

[52] U.S. Cl. ..... 430/115

[58] Field of Search ..... 430/115

[56] References Cited

U.S. PATENT DOCUMENTS

| | | | |
|---|---|---|---|
| 4,339,518 | 7/1982 | Okamura et al. | 430/115 X |
| 4,707,429 | 11/1987 | Trout | 430/115 |
| 5,019,477 | 5/1991 | Felder | 430/115 |
| 5,026,621 | 6/1991 | Tsubuko et al. | 430/109 |
| 5,030,535 | 7/1991 | Drappel et al. | 430/116 |
| 5,035,972 | 7/1991 | El-Sayed et al. | 430/114 |
| 5,045,424 | 9/1991 | Rimai et al. | 430/126 |
| 5,262,266 | 11/1993 | Houle et al. | 430/115 |

FOREIGN PATENT DOCUMENTS

| | | | |
|---|---|---|---|
| 194041 | 11/1983 | Japan | 430/115 |

*Primary Examiner*—Roland Martin
*Attorney, Agent, or Firm*—E. O. Palazzo

[57] ABSTRACT

A negatively charged liquid developer comprised of thermoplastic resin particles, optional pigment, a charge director, and an insoluble charge adjuvant comprised of a copolymer of an alkene and an unsaturated acid derivative, and wherein the acid derivative contains pendant fluoroalkyl or pendant fluoroaryl groups, and wherein the charge adjuvant is associated with or combined with said resin and said optional pigment.

15 Claims, No Drawings

LIQUID DEVELOPER COMPOSITIONS WITH FLUOROALKYL GROUPS

BACKGROUND OF THE INVENTION

This invention is generally directed to liquid developer compositions and, more specifically, the present invention relates to liquid developers containing copolymers of an alkene and unsaturated acid derivatives, such as acrylic acid and methacrylic acid derivatives containing pendant fluoroalkyl or pendant fluoroaryl groups, and which copolymers enable liquid inks or developers with high quality imaging. More specifically, the present invention relates to negatively charged liquid developers comprised of a suitable carrier liquid and as a charge adjuvant, and copolymers comprised of alkylene, such as those with from 1 to about 25 carbon atoms such as ethylene and methacrylic acid esters with the ester groups having pendant fluoroalkyl groups such as trifluoroethyl methacrylate, and the like, covalently bonded thereto. Moreover, the copolymers of the instant invention enable tailored small particle size developer designs, prints with high optical clarity, low toner mass imaging, excellent release and transfer of images from intermediate, low temperature fusing and acceptable desirable fixing of the developed images to a receiver, and acceptable image permanence with reduced paper curl.

The developers of the present invention can be selected for a number of known imaging systems, such as xerographic imaging and printing processes, wherein latent images are rendered visible with the liquid developers illustrated herein. The image quality, solid area coverage and image resolution for developed images usually require, for example, sufficient toner particle electrophoretic mobility. The mobility for effective image development is primarily dependent on the imaging system used, and this electrophoretic mobility is directly proportional to the charge on the toner particles and inversely proportional to the viscosity of the liquid developer fluid. For example, an about 10 to 30 percent change in fluid viscosity caused for instance by an about 5° to 15° C. decrease in temperature could result in a decrease in image quality, poor, or unacceptable image development, and undesirable background development, for example, because of a 5 percent to 23 percent decrease in electrophoretic mobility. Insufficient particle charge can also result in poor, or no transfer of the toner to paper or other substrates. Poor transfer, for example, can result in poor solid area coverage if insufficient toner is transferred to the final substrate and can also result in image defects such as smearing and hollowed fine features. To overcome or minimize such problems, the liquid toners of the present invention were arrived at after extensive research efforts, and which toners result in, for example, sufficient particle charge, generally corresponding to an ESA mobility equal to or greater than $-2.0$ E-10 $m^2/Vs$ for excellent transfer and maintaining the mobility within the desired range of the particular imaging system employed. Advantages associated with the present invention include improvements in the desired negative charge on the developer particles; in some instances the improvement, as measured by ESA mobility, is from $-2.17$ E-10 $m^2/Vs$ without the copolymers of ethylene and methacrylic acid esters with the ester groups having pendant trifluoroethyl groups to $-6.60$ E-10 $m^2/Vs$ when the copolymers of ethylene and methacrylic acid esters with the ester groups having pendant trifluoroethyl groups of the present invention are selected. Moreover, small particle developer can be made such that the average area of the particles can be tailored between 1.22 and 0.355 microns (as determined using a Horiba CAPA 500 centrifugal particle analyzer) by control of the number of pendant fluoroalkyl groups on the copolymers of the instant invention of between 0 and 3.5 mol percent. The greater toner charge and smaller particle size developer results in, for example, improved image development and higher quality images, such as higher resolution with less background deposits.

A latent electrostatic image can be developed with toner particles dispersed in an insulating nonpolar liquid. These dispersed materials are known as liquid toners or liquid developers. A latent electrostatic image may be generated by providing a photoconductive layer with a uniform electrostatic charge and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, the image is developed by colored toner particles dispersed in a nonpolar liquid. The image may then be transferred to a receiver sheet. Also known are ionographic imaging systems.

Typical liquid developers can comprise a thermoplastic resin and a dispersant nonpolar liquid. Generally, a suitable colorant, such as a dye or pigment, is also present in the developer. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 10 $\mu m$ (microns) average by area size as measured with the Horiba CAPA 500 Particle Sizer.

Since the formation of proper images depends primarily on the difference of the charge between the toner particles in the liquid developer and the latent electrostatic image to be developed, it is desirable to add a charge director compound and charge adjuvants which increase the magnitude of the charge, such as polyhydroxy compounds, amino alcohols, polybutylene succinimide compounds, aromatic hydrocarbons, metallic soaps, and the like, to the liquid developer comprising the thermoplastic resin, the nonpolar liquid and the colorant. A charge director can be of importance in controlling the charging properties of the toner to enable excellent quality images.

In U.S. Pat. No. 5,035,972, the disclosure of which is totally incorporated herein by reference, there are illustrated liquid developers with quaternized ammonium AB diblock copolymer charge directors, and wherein the nitrogen in the ionic A block is quaternized with an alkylating agent.

U.S. Pat. No. 5,019,477, the disclosure of which is hereby totally incorporated by reference, discloses a liquid electrostatic developer comprising a nonpolar liquid, thermoplastic resin particles, and a charge director. The ionic or zwitterionic charge directors may include both negative charge directors such as lecithin, oil-soluble petroleum sulfonate and alkyl succinimide, and positive charge directors such as cobalt and iron naphthenates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer of (iii) selected from the group consisting of vinyl toluene and styrene, and (iv) selected from the group consisting of butadiene and acrylate. As the copolymer of polyethylene and methacrylic acid or methacrylic acid alkyl esters, NUCREL ® may be selected.

U.S. Pat. No. 5,030,535 discloses a liquid developer composition comprising a liquid vehicle, a charge control additive and toner particles. The toner particles may contain pigment particles and a resin selected from the group consisting of polyolefins, halogenated polyolefins and mixtures thereof. The liquid developers are prepared by first dissolving the polymer resin in a liquid vehicle by heating at temperatures of from about 80° C. to 120° C., adding pigment to the hot polymer solution and attriting the mixture, and then cooling the mixture so that the polymer becomes insoluble in the liquid vehicle, thus forming an insoluble resin layer around the pigment particles.

U.S. Pat. No. 5,026,621 discloses a toner for electrophotography which comprises as main components a coloring component and a binder resin which is a block copolymer comprising a functional segment (A) consisting of at least one of a fluoroalkylacryl ester block unit or a fluoroalkyl methacryl ester block unit, and a compatible segment (B) consisting of a fluorine-free vinyl or olefin monomer block unit. The functional segment of block copolymer is oriented to the surface of the block polymer and the compatible segment thereof is oriented to be compatible with other resins and a coloring agent contained in the toner so that the toner is provided with both liquid-repelling and solvent-soluble properties.

In U.S. Pat. No. 4,707,429 there are illustrated, for example, liquid developers with an aluminum stearate charge adjuvant. Liquid developers with charge directors are illustrated in U.S. Pat. No. 5,045,425. Also, stain elimination in consecutive colored liquid toners is illustrated in U.S. Pat. No. 5,069,995.

In copending patent application U.S. Ser. No. 986,316, the disclosure of which is totally incorporated herein by reference, there is illustrated a process for forming images which comprises (a) generating an electrostatic latent image; (b) contacting the latent image with a developer comprising a colorant and a substantial amount of a vehicle with a melting point of at least about 25° C., which developer has a melting point of at least about 25° C., and wherein the contact occurs while the developer is maintained at a temperature at or above its melting point, said developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development.

In U.S. Pat. Nos. 5,306,591 and 5,308,731 the disclosures of which are totally incorporated herein by reference, there is illustrated a liquid developer comprised of thermoplastic resin particles, a charge director, and a charge adjuvant comprised of an imine bisquinone; and a liquid developer comprised of a liquid, thermoplastic resin particles, a nonpolar liquid soluble charge director, and a charge adjuvant comprised of a metal hydroxycarboxylic acid, respectively.

In copending patent application U.S. Ser. No. 065,414, the disclosure of which is totally incorporated herein by reference, there is illustrated a liquid developer comprised of thermoplastic resin particles, and a charge director comprised of an ammonium AB diblock copolymer of the formula

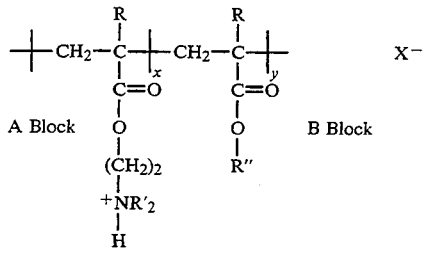

wherein X— is a conjugate base or anion of a strong acid; R is hydrogen or alkyl; R' is alkyl; R'' is an alkyl group containing from about 6 to about 20 carbon atoms; and y and x represent the number average degree of polymerization (DP) wherein the ratio of y to x is in the range of from about 10 to 2 to about 100 to 20. The charge adjuvants and other appropriate components of these copending applications may be selected for the liquid toners of the present invention.

In copending patent application U.S. Ser. No. 200,988, filed Feb. 24, 1994, the disclosure of which is totally incorporated herein by reference, there is illustrated a liquid developer comprised of thermoplastic resin particles, a charge director, and a charge adjuvant comprised of an alkene and unsaturated acid derivatives, such as acrylic acid and methacrylic acid derivatives, containing pendant ammonium groups and which copolymers function as positive charge adjuvants. More specifically, the copending application relates to positively charged liquid developers comprised of a suitable carrier liquid and a charge adjuvant comprised of copolymers of alkylene, such as those with from 1 to about 25 carbon atoms such as ethylene and methacrylic acid esters with the ester groups having pendant ammonium groups such as N,N,N-trimethylammonium bromide, N,N-dimethylamine hydrogen bromide, N,N,N-trimethylammonium tosylate (p-toluenesulfonate), N,N-dimethylamine hydrogen tosylate, N,N,-dimethylamine hydrogen dinonylnaphathalene sulfonate, and the like covalently bonded thereto.

SUMMARY OF THE INVENTION

It is an object of the present invention to provide a liquid developer with many of the advantages illustrated herein.

Another object of the present invention resides in the provision of a liquid developer capable of high particle negative charging.

Another object of the invention is to provide negatively charged liquid developers wherein there are selected as charge adjuvants, or charge control additives copolymers of an alkene and unsaturated acid derivatives, such as acrylic acid and methacrylic acid derivatives, containing pendant fluoroalkyl or fluoroaryl groups.

It is a further object of the invention to provide negatively charged liquid developers wherein there are selected as charge adjuvants, or charge control additives copolymers of ethylene and an $\alpha$-$\beta$-ethylenically unsaturated acid selected from the group consisting of acrylic acid and methacrylic acid derivatives containing pendant fluoroalkyl groups.

It is still a further object of the invention to provide a liquid developer wherein developed image defects, such as smearing, loss of resolution and loss of density, are eliminated, or minimized, and wherein there are selected economical charge directors that permit toners that can be easily transferred from imaging members such as photoreceptor drums.

Also, in another object of the present invention there are provided improved negatively charged liquid developers with certain charge directors.

Another object of the present invention resides in the provision of liquid developers with known additives and a mixture of charge adjuvants, one of which is the copolymer charge adjuvant of the present invention.

Another object of the present invention resides in the ability to attrit liquid and dry developer particles rapidly, for example in less than, or equal to about 6 hours, and more specifically from about 2 to about 5 hours, to tailored dimensions with volume average radii between 0.1 and 2 microns with the use of conventional shot mill attrition methods, a microfluidizer (Microfluidics) or a piston homogenizer (Niro-Soavi).

These and other objects of the present invention can be accomplished in embodiments by the provision of liquid developers with certain charge adjuvants of copolymers comprised of an alkene and an unsaturated acid derivative, such as acrylic acid and methacrylic acid derivatives, and which copolymers contain pendant fluoroalkyl or fluoroaryl groups wherein alkyl contains from 1 to about 30 carbon atoms and aryl contains from 6 to about 24 carbon atoms such as phenyl, naphthyl, benzyl, and the like. In embodiments, the present invention is directed to negatively charged liquid developers comprised of a toner resin, pigment, a charge adjuvant of certain copolymers comprised of an alkene and unsaturated acid derivatives, such as acrylic acid and methacrylic acid derivatives, containing pendant fluoroalkyl groups covalently attached thereto, and wherein copolymer is present in an amount of from about 1 to about 100 weight percent and preferably from about 10 to about 50 weight percent of the toner composition. The aforementioned charge adjuvants can be utilized with a second known charge adjuvant to form a mixture of charge adjuvants, which mixture contains, for example, from about 99.9 to about 90, and preferably from about 95 to about 99 percent by weight based on the total weight of the charge adjuvants in the developer of the copolymer charge adjuvant, and from about 0.1 to about 10 percent by weight based on the total weight of the charge adjuvants in the developer of the second charge adjuvant like aluminum stearate. Preferably, the mixture contains from about 1 to about 5 percent by weight of the second charge adjuvant. Also, in embodiments the charge adjuvant copolymer can function both as a charge additive and as a thermoplastic resin, therefore, in such embodiments no thermoplastic resin is present.

An example of a general formula which can be utilized to illustrate the copolymers of an alkene and unsaturated acid derivatives, such as acrylic acid and methacrylic acid derivatives, containing pendant perfluoro groups of the present invention follows

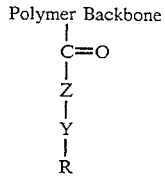

wherein Z and Y are spacer groups.

The polymer backbone is in embodiments comprised of a copolymer of an alkene and an unsaturated acid, such as acrylic acid and methacrylic acid, and the spacer Z is either oxygen or a substituted nitrogen, including nitrogen with alkyl or aryl substituents. In the situation where Z is oxygen, the backbone acid derivative is an ester. In the situation where Z is a substituted nitrogen, the backbone acid derivative is an amide. The nitrogen of the amide can, for example, be bonded to hydrogen, an alkyl group of 1 to about 20 carbons or an aryl or alkyl aryl group of 6 to about 24 carbons. The spacer Y is an alkyl group with a carbon chain length of from about 2 to about 20 carbons, and the carbon chain may contain a cycloaliphatic ring, an aromatic ring or a cycloaliphatic aromatic ring with from about 6 to about 24 carbon atoms, such as cyclohexyl, phenyl, benzyl, naphthyl, tetrahydronaphthyl, cyclohexylphenyl, anthryl, 2-penylethylene, with and without heteroatoms, such as ethyleneoxyethylene and the like. The spacer Y can be nonfluorinated, partly fluorinated, completely fluorinated or perfluorinated, cyclic or noncyclic, linear or branched alkyl of from about 2 to about 20 carbon atoms, or alkylaryl or aryl of about 6 to 24 carbons. The pendent R group, which is attached to the Y spacer as defined in the above structure, may be partly fluorinated or totally fluorinated, cyclic or noncyclic, linear or branched, alkyl, alkylaryl or aryl with or without heteroatoms wherein heteroatoms in Y and R include oxygen, sulfur, phosphorous, nitrogen, fluorine, chlorine, bromine, iodine, silicon, and the like.

Partly fluorinated refers, for example, to some of the hydrogen atoms that are bound to carbon being replaced with fluorine atoms, for example from about 1 to 99 percent for Y and from about 50 to about 99 percent for R. Perfluorinated or completely fluorinated indicates that about 100 percent of the hydrogen atoms bound or attached to carbon have been replaced with fluorine atoms. In the above compolymer formula, cyclicaliphatic includes cyclopentyl, cyclohexyl and the like; noncyclicaliphatic includes methylene, ethylene, propylene, butylene and the like; linear aliphatic includes methylene and the like; branched aliphatic includes isopropylene; and alkyaryl includes benzyl. Generally, aliphatic contains from 2 to about 25 carbon atoms; alkyl contains from 2 to about 25 carbon atoms; and aryl from 6 to about 30 carbon atoms.

Examples of backbone polymers include ethylene vinyl acetate (EVA) copolymers (ELVAX® resins, E.I. DuPont de Nemours and Company, Wilmington, Del.); copolymers of ethylene and an $\alpha$-$\beta$-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); ethylene ethyl acrylate series sold under the trademark BAKELITE® DPD 6169, DPDA 6182 NATURAL™ (Union Carbide Corporation, Stamford, Conn.); SURLYN® ionomer resin (E.I. DuPont de Nemours and Company), poly(-propylene-acrylic acid), poly(methylvinylether-maleic acid), poly(propylene-ethylene-acrylic acid), poly(styrene-maleic anhydride), poly(octadecene-maleic anhydride); or blends thereof. Preferred backbone copolymers selected in embodiments are comprised of the copolymer of ethylene and an $\alpha$-$\beta$-ethylenically unsaturated acid of either acrylic acid or methacrylic acid. In one preferred embodiment, NUCREL® resins available from E.I. DuPont de Nemours and Company like NUCREL 599®, NUCREL 699®, or NUCREL 960® are selected as the polymer backbone. Other preferred polymer backbones include PRIMACORE® resins available from Dow Chemical Company, ACLYN® resins available form Allied Chemical Company, and GULF PE 2207 TM (a 20 weight percent methyl acrylate-ethylene copolymer available from Chevron).

In embodiments, the present invention is directed to negatively charged liquid developers comprised of a toner resin, pigment, and a charge adjuvant, including copolymers of ethylene and methacrylic acid esters with the ester groups having pendant fluoroalkyl groups such as trifluoroethyl, pentafluoropropyl, heptafluorobutyl, and the like. Examples of specific charge adjuvants include copolymers of ethylene and trifluoroethylmethacrylate, copolymers of ethylene and heptafluorobutylmethacrylate, and the like.

Embodiments of the present invention include a liquid developer comprised of thermoplastic resin particles, and a charge adjuvant comprised of copolymers of an alkene and unsaturated acid derivatives, such as acrylic acid and methacrylic acid derivatives, containing pendant fluoroalkyl groups as illustrated herein; a liquid developer comprised of a liquid component, thermoplastic resin; a charge adjuvant comprised of certain copolymers comprised of an alkene and unsaturated acid derivatives, such as acrylic acid and methacrylic acid derivatives, containing pendant fluoroalkyl groups, a charge director compound as illustrated herein, and a liquid electrostatographic developer comprised of (A) a nonpolar liquid with a viscosity of from about 0.5 to about 20 centipoise and a resistivity about equal to or greater than $5\times10^9$ ohm-cm with a preferred range of from about $10^{10}$ to about $10^{14}$ ohm-cm and present in a major amount of from about 50 percent to about 99.5 weight percent; (B) thermoplastic resin particles with an average volume particle diameter of from about 0.1 to about 30 microns, and which particles are present in an amount of from about 0 percent to about 90 percent of the developer solids with developer solids being comprised of thermoplastic resin, optional pigment, and charge adjuvant; (C) pigment; (D) an optional second charge adjuvant which is present in an amount of from about 0.1 percent to about 10 percent of the developer solids; and wherein the charge adjuvant is comprised of copolymers of an alkene and unsaturated acid derivatives, such as acrylic acid and methacrylic acid derivatives containing fluoroalkyl or fluoroaryl groups as illustrated herein, and wherein the charge adjuvant is associated with or combined, preferably permanently, with the resin and pigment; and which copolymers are present in the developer in an amount of from about 1 percent solids to about 95 percent of developer solids, and preferably form about 50 percent to about 90 percent of developer solids; (E) a charge director compound such as those described in copending patent application U.S. Ser. No. 065,414, which director is present in an amount ranging from about 0.25 to about 1,500 milligrams/gram, and preferably from about 2.5 to about 400 milligrams/gram based on the amount of developer solids comprised of resin, pigment, fluorine containing resin, and charge adjuvant.

In embodiments, the present invention relates to a liquid developer comprised of thermoplastic resin particles, and a charge adjuvant comprised of copolymers of an alkene and unsaturated acid derivatives, such as acrylic acid and methacrylic acid derivatives, containing fluoroalkyl groups as illustrated herein.

A negatively charged liquid developer of the present invention having a charge sufficient to result in a particle mobility greater than or equal to about $2.0\times10^{-10}$ $m^2/Vs$ and preferably greater than $-2.50\times10^{-10}$ $m^2/Vs$ as measured with the Matec ESA apparatus is, for example, comprised of a liquid component, optional thermoplastic resin, a charge adjuvant, and copolymers comprised of an alkene and unsaturated acid derivatives, such as acrylic acid and methacrylic acid derivatives, containing pendant fluoroalkyl groups and the like. The copolymers with pendant fluoroalkyl groups of the instant invention are present in various effective amounts, such as for example from about 1 to about 100 weight percent of the liquid toner solids, which include resin, optional pigment and charge adjuvant, and a charge director; and a liquid electrostatographic developer comprised of (A) a liquid having viscosity of from about 0.5 to about 20 centipoise and a resistivity equal to or greater than about $5\times10^9$; (B) thermoplastic resin particles with an average volume particle diameter of from about 0.1 to about 30 microns; (C) an optional charge adjuvant; (D) certain copolymers comprised of an alkene and unsaturated acid derivatives, such as acrylic acid and methacrylic acid derivatives, containing pendant fluoroalkyl groups as illustrated herein; and (E) a charge director.

In embodiments, it is important that the toner particle be comprised of the thermoplastic resin, optional second charge adjuvant, certain copolymers comprised of an alkene and unsaturated acid derivatives, such as acrylic acid and methacrylic acid derivatives, containing pendant fluoroalkyl groups, and pigment. Therefore, it is important that the thermoplastic resin, copolymers with pendant fluorinated groups as illustrated herein, and the optional second charge adjuvant be sufficiently compatible that they do not form separate particles, and that the charge adjuvant be insoluble in the hydrocarbon to the extent that no more than 0.1 weight percent be soluble in the nonpolar liquid.

The charge director can be selected for the liquid developers in various effective amounts, such as, for example in embodiments, from about 0.25 to about 1,500 milligrams of charge director per gram of toner solids and preferably 2.5 to 400 milligrams/gram of toner solids. Developer solids include toner resin, optional pigment, the fluorine containing copolymer resin illustrated herein, and charge adjuvant. Without pigment, the developer may be selected for the generation of a resist, a printing plate, and the like.

Suitable nonpolar liquid soluble ionic or zwitterionic charge director compounds, which can be selected in various effective amounts, such as for example from about 0.25 to about 1,500 milligrams/gram, and preferably 2.5 to 400 milligrams/gram based on the amount of developer solids comprised of resin, pigment, fluorine containing copolymer resin, and charge adjuvant, include anionic glyceride, such as EMPHOS D70-

30C TM and EMPHOS F27-85 TM, available from Witco Corporation, New York, N.Y., which are sodium salts of phosphated mono and diglycerides with unsaturated and saturated acid substituents, respectively, lecithin, BASIC BARIUM PETRONATE®, NEUTRAL BARIUM PETRONATE®, CALCIUM PETRONATE®, NEUTRAL CALCIUM PETRONATE®, oil soluble petroleum sulfonates, Witco Corporation, New York, N.Y.; and metallic soaps such as barium, calcium, lead, and zinc stearates; cobalt, manganese, lead, and zinc linoleates; calcium and cobalt octoates; quaternary ammonium block copolymers as illustrated, for example, in U.S. Pat. No. 5,035,972, the disclosure of which is totally incorporated herein by reference; other known charge directors, and the like. Examples of charge directors are illustrated in U.S. Ser. No. 065,414, the disclosure of which is totally incorporated herein by reference.

Examples of liquid carriers, or nonpolar liquids selected for the developers of the present invention include a liquid with an effective viscosity as measured, for example, by a number of known methods, such as capillary viscometers, coaxial cylindrical rheometers, cone and plate rheometers, and the like of, for example, from about 0.5 to about 500 centipoise, and preferably from about 1 to about 20 centipoise, and a resistivity equal to or greater than $5\times10^9$ ohm-cm and less than $1\times10^{20}$ ohm-cm, such as $5\times10^{13}$. Preferably, the liquid selected is a branched chain aliphatic hydrocarbon as illustrated herein. A nonpolar liquid of the ISOPAR® series (manufactured by the Exxon Corporation) may also be used for the developers of the present invention. These hydrocarbon liquids are considered narrow portions of isoparaffinic hydrocarbon fractions with extremely high levels of purity. For example, the boiling point range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto-ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPARM® has a flash point of 80° C. as determined by the ASTM D-56 method. The liquids selected should have an electrical volume resistivity in excess of $10^9$ ohm-centimeters and a dielectric constant below 3.0. Moreover, the vapor pressure at 25° C. should be less than 10 Torr in embodiments. The amount of liquid carrier or nonpolar liquid is 75 to 99.9 weight percent and preferably between 95 and 99 weight percent.

Although, in embodiments the ISOPAR® series liquids are the preferred nonpolar liquids for use as dispersants in the liquid developers of the present invention, the essential characteristics of viscosity and resistivity may be achieved with other suitable liquids. Specifically, the NORPAR® series available from Exxon Corporation, the SOLTROL® series available from the Phillips Petroleum Company, and the SHELLSOL® series available from the Shell Oil Company can be selected.

The amount of the liquid employed in the developer of the present invention is, for example, from about 50 percent to about 99.5 percent, and preferably from about 95 to about 99 percent by weight of the total developer dispersion. The total solids content of the developer is, for example, from about 0.5 to about 50 percent by weight, and preferably 1.0 to 5 percent.

Typical suitable thermoplastic toner resins can be selected for the liquid developers of the present invention in effective amounts of, for example, in the range of about 90 percent to about 0 percent, and preferably from about 50 percent to about 5 percent of developer solids comprised of thermoplastic resin, pigment, charge adjuvant, and in embodiments other optional components such as magnetic materials, like magnetites that may comprise the developer. Generally, developer solids include the thermoplastic resin, optional pigment and charge adjuvant. Examples of thermoplastic resins include ethylene vinyl acetate (EVA) copolymers (ELVAX® resins, E.I. DuPont de Nemours and Company, Wilmington, Del.); copolymers of ethylene and an $\alpha$-$\beta$-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series sold under the trademark BAKELITE® DPD 6169, DPDA 6182 NATURAL TM (Union Carbide Corporation, Stamford, Conn.); ethylene vinyl acetate resins like DQDA 6832 Natural 7 (Union Carbide Corporation); SURLYN® ionomer resin (E.I. DuPont de Nemours and Company); or blends thereof; polyesters; polyvinyl toluene; polyamides; styrene/butadiene copolymers; epoxy resins; acrylic resins, such as copolymers of acrylic or methacrylic acid, and at least one alkyl ester of acrylic or methacrylic acid wherein alkyl is 1 to about 20 carbon atoms, such as methyl methacrylate (50 to 90 percent)/methacrylic acid (0 to 20 percent)/ethylhexyl acrylate (10 to 50 percent); and other acrylic resins including ELVACITE® acrylic resins (E.I. DuPont de Nemours and Company); or blends thereof. Preferred copolymers selected in embodiments are comprised of the copolymer of ethylene and an $\alpha$-$\beta$-ethylenically unsaturated acid of either acrylic acid or methacrylic acid. In preferred embodiments, NUCREL® resins available from E.I. DuPont de Nemours and Company like NUCREL 599®, NUCREL 699®, or NUCREL 960® are selected as the thermoplastic resin. The thermoplastic resin can be absent in embodiments as indicated herein.

The liquid developer of the present invention preferably contains a colorant dispersed in the resin particles. Colorants, such as pigments or dyes like black, cyan, magenta, yellow, red, blue, green, brown, and mixtures, such as wherein any one colorant may comprise from 0.1 to 99.9 weight percent of the colorant mixture with another or other colorants comprising the remaining percentage thereof, are preferably present to render the latent image visible.

The colorant may be present in the resin particles in an effective amount of, for example, from about 0.1 to about 60 percent, and preferably from about 10 to about 30 percent by weight based on the total weight of solids contained in the developer. The amount of colorant used may vary depending on the use of the developer, for instance if the toned image is to be used to form a chemical resist image no pigment is necessary. Examples of pigments, which may be selected, include carbon blacks available from, for example, Cabot Corporation (Boston, Mass.), such as MONARCH 1300®, REGAL 330® and BLACK PEARLS®, and color pigments like FANAL PINK TM, PV FAST BLUE TM, and Paliotol Yellow D1155; pigments as illustrated in U.S. Pat. No. 5,223,368, the disclosure of which is totally incorporated herein by reference; and the following.

| PIGMENT BRAND NAME | MANU-FACTURER | COLOR |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chemical | Yellow 14 |
| L75-1331 Yellow | Sun Chemical | Yellow 17 |
| Hansa Yellow RA | Hoechst | Yellow 73 |
| Hansa Brilliant Yellow 5GX-02 | Hoechst | Yellow 74 |
| DALAMAR ® YELLOW YT-858-D | Heubach | Yellow 74 |
| Hansa Yellow X | Hoechst | Yellow 75 |
| NOVAPERM ® YELLOW HR | Hoechst | Yellow 83 |
| L75-2337 Yellow | Sun Chemical | Yellow 83 |
| CROMOPHTHAL ® YELLOW 3G | Ciba-Geigy | Yellow 93 |
| CROMOPHTHAL ® YELLOW GR | Ciba-Geigy | Yellow 95 |
| NOVAPERM ® YELLOW FGL | Hoechst | Yellow 97 |
| Hansa Brilliant Yellow 10GX | Hoechst | Yellow 98 |
| LUMOGEN ® LIGHT YELLOW | BASF | Yellow 110 |
| Permanent Yellow G3R-01 | Hoechst | Yellow 114 |
| CROMOPHTHAL ® YELLOW 8G | Ciba-Geigy | Yellow 128 |
| IRGAZINE ® YELLOW 5GT | Ciba-Geigy | Yellow 129 |
| HOSTAPERM ® YELLOW H4G | Hoechst | Yellow 151 |
| HOSTAPERM ® YELLOW H3G | Hoechst | Yellow 154 |
| HOSTAPERM ® ORANGE GR | Hoechst | Orange 43 |
| PALIOGEN ® ORANGE | BASF | Orange 51 |
| IRGALITE ® RUBINE 4BL | Ciba-Geigy | Red 57:1 |
| QUINDO ® MAGENTA | Mobay | Red 122 |
| INDOFAST ® BRILLIANT SCARLET | Mobay | Red 123 |
| HOSTAPERM ® SCARLET GO | Hoechst | Red 168 |
| Permanent Rubine F6B | Hoechst | Red 184 |
| MONASTRAL ® MAGENTA | Ciba-Geigy | Red 202 |
| MONASTRAL ® SCARLET | Ciba-Geigy | Red 207 |
| HELIOGEN ® BLUE L 6901F | BASF | Blue 15:2 |
| HELIOGEN ® BLUE TBD 7010 | BASF | Blue:3 |
| HELIOGEN ® BLUE K 7090 | BASF | Blue 15:3 |
| HELIOGEN ® BLUE L 7101F | BASF | Blue 15:4 |
| HELIOGEN ® BLUE L 6470 | BASF | Blue 60 |
| HELIOGEN ® GREEN K 8683 | BASF | Green 7 |
| HELIOGEN ® GREEN L 9140 | BASF | Green 36 |
| MONASTRAL ® VIOLET | Ciba-Geigy | Violet 19 |
| MONASTRAL ® RED | Ciba-Geigy | Violet 19 |
| QUINDO ® RED 6700 | Mobay | Violet 19 |
| QUINDO ® RED 6713 | Mobay | Violet 19 |
| INDOFAST ® VIOLET | Mobay | Violet 19 |
| MONASTRAL ® VIOLET Maroon B | Ciba-Geigy | Violet 42 |
| STERLING ® NS BLACK | Cabot | Black 7 |
| STERLING ® NSX 76 | Cabot | |
| TIPURE ® R-101 | DuPont | White 6 |
| MOGUL ® L | Cabot | Black, Cl 77266 |
| UHLICH ® BK 8200 | Paul Uhlich | Black |

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is important for image development and background cleaning. Toner particle mobility can be measured using the electroacoustics effect, the application of an electric field and the measurement of sound described in U.S. Pat. No. 4,497,208, the disclosure of which is totally incorporated herein by reference. This technique is particularly useful for nonaqueous dispersions because the measurements can be accomplished at high volume loadings, for example greater than 1 weight percent. Measurements rendered by this technique have been shown to correlate with image quality, that is for example high mobilities have been shown to result in improved image density, higher image resolution and superior transfer efficiency, for example U.S. Pat. No. 5,066,821, U.S. Pat. No. 5,034,299, and U.S. Pat. No. 5,028,508, the disclosures of which are totally incorporated herein by reference. Residual conductivity, that is the conductivity from the charge director, can be measured with a low field device as described in the Examples.

To increase the toner particle charge and, accordingly, increase the mobility and transfer latitude of the toner particles, second optional charge adjuvants may be added to the toner particles. For example, adjuvants, such as metallic soaps, like aluminum or magnesium stearate or octoate, fine particle size oxides, such as oxides of silica, alumina, titania, and the like, para-toluenesulfonic acid, and polyphosphoric acid, may be added. Negative charge adjuvants increase the negative charge of the toner particle, while the positive charge adjuvants increase the positive charge of the toner particles. Examples of these adjuvants are illustrated in U.S. Pat. Nos. 5,306,591 and 5,308,731, the disclosures of which are totally incorporated herein by reference.

With the invention of the present application, in embodiments the first charge adjuvant or charge additive are comprised of copolymers of an alkene and unsaturated acid derivatives, such as acrylic acid and methacrylic acid derivatives, containing pendant fluoroalkyl groups as charge adjuvants including copolymers of ethylene and methacrylic acid esters with the ester groups having pendant fluoroalkyl groups such as copolymers of ethylene and trifluoroethylmethacrylate, copolymers of ethylene and heptafluorobutylmethacrylate, copolymers of ethylene and pentafluoropropylmethacrylate, and the like. The adjuvants can be added to the liquid toner particles in an amount of from about 1 percent to about 100 percent of the total developer solids of thermoplastic resin when present, pigment, and charge adjuvant, and preferably from about 50 percent to about 95 percent of the total weight of solids contained in the developer. When the charge adjuvant copolymers of the present invention are employed, a negatively charged liquid developer is obtained having a charge sufficient to result in a particle mobility greater than $-2.0\times10^{-10}$ $m^2/Vs$ and preferably greater than $-2.50\times10^{-10}$ $m^2/Vs$, as measured with the Matec ESA apparatus.

The liquid electrostatic developer of the present invention can be prepared by a variety of known processes, such as, for example, mixing in a nonpolar liquid with the thermoplastic resin, copolymer, charge adjuvant, and optional colorant in a manner that the resulting mixture contains about 15 to about 30 percent by weight of solids, where solids include the resin in an amount ranging from 0 to about 99 percent, and preferably 40 percent to 90 percent of the solids, pigment in the amount range of 0 to 60 percent, preferably 5 to 40 percent of the solids, and wherein the charge adjuvant is present in the amount range of from about 1 to about 100 percent, and preferably 10 to 50 percent of the solids; heating the mixture to a temperature of from about 70° C. to about 130° C. until a uniform dispersion is formed; adding an additional amount of nonpolar liquid sufficient to decrease the total solids concentration of the developer to about 10 to about 20 percent by weight; cooling the dispersion to about 10° C. to about 50° C.; adding the charge director compound to the dispersion; and diluting the dispersion to between 1 percent and 2 percent solids.

In the initial mixture, the resin, colorant copolymer charge adjuvant, and second charge adjuvant may be added separately to an appropriate vessel which can vary in size from 50 milliliters to 1,000 liters such as, for example, an attritor, heated ball mill, heated vibratory mill, such as a Sweco Mill (manufactured by Sweco Company, Los Angeles, Calif.) equipped with particulate media for dispersing and grinding, and a Ross double planetary mixer (manufactured by Charles Ross and Son, Hauppauge, N.Y.), or a two roll heated mill, which requires no particulate media. Useful particulate grinding media include materials like a spherical cylinder selected from the group consisting of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters).

Sufficient nonpolar liquid is added to provide a dispersion of from about 15 to about 50 percent solids. This mixture is then subjected to elevated temperatures during the initial mixing procedure to plasticize and soften the resin. The mixture is sufficiently heated to provide a uniform dispersion of all the solid materials of, for example, colorant, adjuvant and resin. However, the temperature at which this step is undertaken should not be so high as to degrade the nonpolar liquid or decompose the resin or colorant if present. Accordingly, the mixture in embodiments is heated to a temperature of from about 70° C. to about 130° C., and preferably from about 75° C. to about 110° C. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the dispersion. The amount of nonpolar liquid to be added at this point should be an amount sufficient to decrease the total solids concentration of the dispersion to about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid like water, or glycols, such as ethylene glycol, in a jacket surrounding the mixing vessel. Cooling is accomplished, for example, in the same vessel, such as an attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably from about 2 to about 6 hours. Additional liquid may be added at any time during the preparation of the liquid developer to facilitate grinding or to dilute the developer to the appropriate percent solids needed for developing. Other processes of preparation are generally illustrated in U.S. Pat. Nos. 4,760,009; 5,017,451; 4,923,778 and 4,783,389, the disclosures of which are totally incorporated herein by reference.

Embodiments of the invention will be illustrated in the following nonlimiting Examples, it being understood that these Examples are intended to be illustrative only, and that the invention is not intended to be limited to the materials, conditions, process parameters and the like recited herein. The conductivity of the liquid toner dispersions and charge director solutions were determined with a Scientifica 627 Conductivity Meter (Scientifica, Princeton, N.J.). The measurement signal for this meter is a low distortion 18 hz sine wave with an amplitude of 5.4 to 5.8 volts rms. Toner particle mobilities and zeta potentials were determined with a MBS-8000 electrokinetic sonic analysis (ESA) system (Matec Applied Science Hopkinton, Mass.). The system was calibrated in the aqueous mode per manufacturer's recommendation to provide an ESA signal corresponding to a zeta potential of −26 millivolts for a 10 percent (v/v) suspension of LUDOX TM (DuPont). The system was then set up for nonaqueous measurements. The toner particle mobility is dependent on a number of factors including particle charge and particle size. The ESA system also calculates the zeta potential which is directly proportional to toner charge and is independent of particle size. Particle size was measured by the Horiba CAPA-500 and 700 centrifugal automatic particle analyzers manufactured by Horiba Instruments, Inc, Irvine, Calif.

EXAMPLE I

Preparation of NUCREL 599 ®-Trifluoroethyl Ester (26383-97)

NUCREL 599 ® was chemically modified to, for example, control the charging properties of the resin particles in liquid immersion development (LID) inks. NUCREL ® fluoroalkylesters can be selected as the main resin component in liquid immersion inks or as a charge control additive with other resins, such as NUCREL ® based resins and inks. The esters were prepared by the sulfuric acid catalyzed esterification reaction between fluoro-alcohols, such as 2,2,2-trifluoroethanol, and NUCREL 599 ®, as illustrated hereinafter.

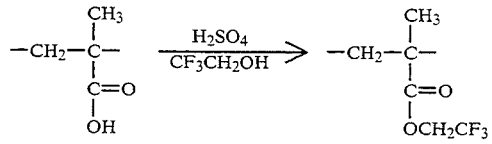

NUCREL 599 ® (25 grams, polyethylene-3.49-mol percent-methacrylic acid copolymer available from E.I. DuPont de Nemours), toluene (375 milliliters), concentrated sulfuric acid (10 grams), and 2,2,2-trifluoroethanol (100 grams) were boiled at reflux for 96 hours using a silicone oil bath at 85° C. in a 500 milliliter, 3-neck flask equipped with a reflux condenser, mechanical stirrer and rubber septum. The resulting hot purple solution was added to 2 liters of methanol using a Waring blender, and the polymer that precipitated was isolated by filtration and then vacuum dried. The product obtained in 98 percent yield was polyethylene-3.45-mol percent-trifluoroethyl methacrylate copolymer. The trifluoroethyl ester of NUCREL 599® was found to charge liquid ink particles strongly negative, as described in the following Example II, in combination with WITCO 22 TM (aluminum stearate) used as the second charge control agent (charge adjuvant), and with the HBr-Quat charge director, reference the structure illustrated herein for the AB diblock, and reference U.S. Ser. No. 065,414 (Example IV), the disclosure of which is totally incorporated herein by reference.

EXAMPLE II

Preparation of Cyan LID Ink Made with NUCREL 599®-Trifluoroethyl Ester (26384-5)

NUCREL 599®-trifluoroethyl ester (26384-5, 5.06 grams), PV FAST BLUE TM (1.30 grams), WITCO 22 TM (aluminum stearate, 0.13 gram) and ISOPAR L TM (170 grams) were heated in a Union Process O1 attritor containing stainless steel 3/16-inch chrome-coated shot (2,400 grams) until 200° F. was achieved. After 10 minutes, heating was discontinued and ambient temperature stirring was maintained for 2 hours. Water cooling with stirring was then continued for 4 more hours. The resulting ink was allowed to flow from the shot using a strainer, and the calculated weight percent solids of the resultant ink was 3.68. The determined weight percent solids (comprised of 78 weight percent of resin, 20 weight percent of PV FAST BLUE TM and 2.0 weight percent of WITCO 22 TM) was 3.59. The weight percent solids was determined by average weight loss on drying of 4.5 gram ink samples heated in an aluminum pan using a sun lamp for 24 hours. A 1 weight percent solids ink was prepared and analyzed using electrosonic analysis. Electrosonic analysis (ESA) is generally used to determine the electrophoretic mobility and zeta potential of liquid inks. In general, high ESA zeta potentials (>100 millivolts) correlate well with good developability in liquid printing processes that produce high quality images with low background. The 1 weight percent solids ink was prepared by diluting 55.7 grams of ink concentrate at 3.59 weight percent solids with 144.3 grams of ISOPAR L TM (Exxon). After 48 hours, the ink prepared at 1 weight percent solids and with 50 milligrams of HBr-Quat charge director, reference U.S. Ser. No. 065,414, Example IV, per gram of ink solids(comprised of 78 weight percent of polyethylene-3.45-mol percent-trifluoroethyl methacrylate copolymer, 20 weight percent of PV FAST BLUE TM, and 2 weight percent of WITCO 22 TM) had an ESA electrophoretic mobility of $-6.60\times10^{-10}$ m$^2$/v.second, a zeta potential of $-171.7$ millivolts, and a conductivity of 22 pmho/centimeter. The average (area) radius of the particles (by Horiba CAPA 500) was 0.355 micron. After 91 days, the same ink at 1 weight percent solids and with 50 milligrams of HBr-Quat charge director per gram of ink solids had an ESA electrophoretic mobility of $-5.43\times10^{-10}$ m$^2$/v.second, a zeta potential of $-137.5$ millivolts, and a conductivity of 16 pmho/centimeter. Thus, the ink particles had stable electrical properties on aging.

CONTROL 1

Preparation of Control Cyan LID Ink with NUCREL 599® (26383-25)

NUCREL 599® (25.0 grams, polyethylene-3.49-mol percent-methacrylic acid copolymer available from E.I. DuPont de Nemours), PV FAST BLUE TM (6.41 grams), WITCO 22 TM (aluminum stearate, 0.641 gram) and ISOPAR L TM (170 grams) were heated in a Union Process O1 attritor containing stainless steel 3/16-inch chrome coated shot (2,400 grams) until 200° F. was achieved. After 10 minutes, heating was discontinued and ambient temperature stirring was maintained for 2 hours. Water cooling with stirring was then continued for 4 more hours. The ink was washed off the shot using a strainer and 408.2 grams of ISOPAR L TM, and the calculated weight percent solids of the resultant ink was 5.25. The determined weight percent solids was 5.00, as determined by weight loss on drying from 4.5 gram samples using a sun lamp heat source for 24 hours. The composition of the ink solids was 78 weight percent of resin, 20 weight percent of PV FAST BLUE TM and 2.0 weight percent of aluminum stearate. A 1 weight percent solids ink was made by diluting 40 grams of ink concentrate at 5 weight percent of solids with 160 grams of ISOPAR L TM (Exxon). This ink at 1 weight percent of solids with 50 milligrams of HBr-Quat charge director, reference U.S. Ser. No. 065,414, Example IV, per gram of ink solids (which consisted of 78 weight percent of NUCREL 599 ®, 20 weight percent of PV FAST BLUE TM, and 2.0 weight percent of WITCO 22 TM) had an ESA electrophoretic mobility of $-3.11\times10^{-10}$ m$^2$/V.second, a zeta potential of $-172.7$ millivolts, and a high conductivity of 27 pmho/centimeter. The average radius (area) of the particles (by Horiba CAPA 500) was 1.22 microns.

It is believed that similar inks and similar results can be obtained without the second charge additive of aluminum stearate.

Other embodiments and modifications of the present invention may occur to those skilled in the art subsequent to a review of the information presented herein; these embodiments and modifications, as well as equivalents thereof, are also included within the scope of this invention.

What is claimed is:

1. A negatively charged liquid electrostatographic developer comprised of (A) a liquid with a viscosity of from about 0.5 to about 20 centipoise and resistivity greater than or equal to from about $5\times10^9$ ohm-cm to about $1\times10^{20}$ ohm-cm; (B) thermoplastic resin particles with an average volume particle diameter of from about 0.1 to about 30 microns, and pigment; (C) second charge adjuvant; (D) first charge adjuvant of a copolymer comprised of ethylene and an $\alpha$-$\beta$-ethylenically unsaturated acid selected from the group consisting of acrylic acid and methacrylic acid derivatives, and which copolymer contains pendant fluoroalkyl or fluoroaryl groups; and (E) a charge director; and wherein the charge adjuvants are associated with or combined with said resin and said pigment; and wherein said second charge adjuvant is selected from the group consisting of aluminum stearate, and aluminum-hydroxy-bis(di-tert-butylsalicylate).

2. A developer in accordance with claim 1 wherein the pigment is present in an amount of about 0.1 to about 60 percent by weight based on the total weight of the developer solids of resin and pigment.

3. A developer in accordance with claim 1 wherein the pigment is black, cyan, magenta, yellow, or mixtures thereof.

4. A developer in accordance with claim 1 wherein the pigment is carbon black.

5. A developer in accordance with claim 1 wherein component (A) is present in an amount of from about 85 percent to about 99.9 percent by weight, based on the total weight of developer solids, and wherein said solids are comprised of thermoplastic resin, pigment, charge adjuvant, and said fluorinated copolymer; and the solids comprise from about 0.1 percent to about 15 percent by weight; and component (E) is present in an amount of from about 5 to about 1,000 milligrams/gram of developer solids.

6. A developer in accordance with claim 1 wherein component (D) is present in an amount of from about 1 to about 100 percent by weight of developer solids.

7. A developer in accordance with claim 1 wherein the liquid is an aliphatic hydrocarbon.

8. A developer in accordance with claim 7 wherein the aliphatic hydrocarbon is a mixture of branched hydrocarbons with from about 12 to about 20 carbons atoms, or wherein the aliphatic hydrocarbon is a mixture of normal hydrocarbons of from about 10 to about 20 carbon atoms.

9. A negatively charged liquid electrostatographic developer comprised of (A) a liquid with a viscosity of from about 0.5 to about 20 centipoise and a resistivity greater than or equal to from about $5\times10^9$ ohm-cm to about $1\times10^{20}$ ohm-cm; (B) thermoplastic resin particles with an average volume particle diameter of from about 0.1 to about 30 microns, and pigment; (C) second charge adjuvant; (D) first charge adjuvant of a copolymer comprised of ethylene and an $\alpha$-$\beta$-ethylenically unsaturated acid selected from the group consisting of acrylic acid and methacrylic acid derivatives, and which copolymer contains pendant fluoroalkyl or fluoroaryl groups; and (E) a charge director; and wherein the charge adjuvants are associated with or combined with said resin and said pigment, and wherein the second charge adjuvant is a metal soap.

10. A negatively charged liquid electrostatographic developer comprised of (A) a liquid with a viscosity of from about 0.5 to about 20 centipoise and a resistivity greater than or equal to from about $5\times10^9$ ohm-cm to about $1\times10^{20}$ ohm-cm; (B) thermoplastic resin particles with an average volume particle diameter of from about 0.1 to about 30 microns, and pigment; (C) second charge adjuvant; (D) first charge adjuvant of a copolymer comprised of ethylene and an $\alpha$-$\beta$-ethylenically unsaturated acid selected from the group consisting of acrylic acid and methacrylic acid derivatives, and which copolymer contains pendant fluoroalkyl or fluoroalkyl groups; and (E) a charge director; and wherein the charge adjuvants are associated with or combined with said resin and said pigment, and wherein the second charge adjuvant is an aluminum soap, or an alkyl or aryl salicylic acid aluminum complex.

11. A negatively charged liquid electrostatographic developer comprised of (A) a liquid with a viscosity of from about 0.5 to about 20 centipoise and a resistivity greater than or equal to from about $5\times10^9$ ohm-cm to about $1\times10^{20}$ ohm-cm; (B) thermoplastic resin particles with an average volume particle diameter of from about 0.1 to about 30 microns, and pigment; (C) second charge adjuvant; (D) first charge adjuvant of a copolymer comprised of ethylene and an $\alpha$-$\beta$-ethylenically unsaturated acid selected from the group consisting of acrylic acid and methacrylic acid derivatives, and which copolymer contains pendant fluoroalkyl or fluoroaryl groups; and (E) a charge director; and wherein the charge adjuvants are associated with or combined with said resin and said pigment, and wherein the charge director is an ammonium AB diblock copolymer of the following formula

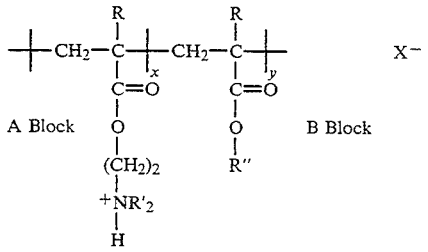

wherein X— is a conjugate base or anion of a strong acid; R is hydrogen or alkyl; R′ is alkyl; R″ is an alkyl group containing from about 6 to about 20 carbon atoms; and y and x represent the number average degree of polymerization (DP) wherein the ratio of y to x is in the range of from about 10 to 2 to about 100 to 20.

12. A developer in accordance with claim 10 wherein said second charge adjuvant is a hydroxy bis(3,5-di-tert-butyl salicyclic) aluminate monohydrate.

13. An imaging method which comprises forming an electrostatic latent image followed by the development thereof with the liquid developer of claim 1.

14. A developer in accordance with claim 1 wherein the acid derivative is an amide or an ester.

15. A developer in accordance with claim 11 wherein the pendant fluoroalkyl or fluoroaryl groups are covalently bonded to said acid derivative.

* * * * *